United States Patent [19]

Echeberria

[11] Patent Number: 4,843,747

[45] Date of Patent: Jul. 4, 1989

[54] ACCESSORIES FOR MUZZLE-LOADING FIREARMS

[75] Inventor: D. Julian Echeberria, Eibar, Spain

[73] Assignee: Dikar, S. Coop. Ltda, Guipuzcoa, Spain

[21] Appl. No.: 196,070

[22] Filed: May 17, 1988

[51] Int. Cl.[4] ..... F41C 27/00

[52] U.S. Cl. ..... 42/90

[58] Field of Search ..... 42/90, 83

[56] References Cited

U.S. PATENT DOCUMENTS 4,334,376 6/1982 Winslow ..... 42/90

4,571,873 2/1986 Houk ..... 42/90

OTHER PUBLICATIONS

*Dikar Accesorios Avancarga*—Accessories for Muzzleloading (brochure).

*Primary Examiner*—Charles T. Jordan

*Attorney, Agent, or Firm*—Browdy and Neimark

[57] ABSTRACT

Accessories for muzzle-loading firearms including a wrench for working with the nipples of muzzle-loading firearms, with a cylindrical tubular body equipped with a truncated conical end with a circular longitudinal axial opening. A continuation of this opening, which is circular, receives replacement nipples controlled by the end of the opening itself and by a pin that goes through the base body. A nut plugs the opening in the tubular body and is screwed onto the other inside end of the base body. The nut is provided with a rod which passes through the pin and the nipples. A further accessory is provided in the form of a ramrod provided with metal ends pressure-fit and secured to the wood body of the ramrod by some notches that penetrate into the wood of the ramrod.

6 Claims, 2 Drawing Sheets

ACCESSORIES FOR MUZZLE-LOADING FIREARMS

BACKGROUND OF THE INVENTION

1. Field of the Invention

This invention relates to accessories employed in the use of muzzle-loading firearms, preferably rifles and pistols, and more specifically to the nipple wrench, used to loosen and tighten the nipples in the firearm to clean them or replace them with others, and the ramrod used in the operations of loading the firearms.

2. The Prior Art

Wrenches are usually made from a solid bar with one of its ends suitably machined, by milling, to provide two lateral lugs between whose lateral walls is housed the central portion of the nipple. For this purpose, such a nipple comprises bevels with the central portion, another threaded portion to be placed by the thread in an opening of the firearm and a third portion generally truncated conical on its outside in which the cap to be actuated by the hammer is received.

From the effects of continued use it becomes necessary at times to unscrew the nipple from its place in the firearm, both to clean it and to replace it with another, all of which requires continuous use of such a wrench, which results in breaking of the wrench lugs by the force applied and by the fatigue of the material itself.

On the other hand, the axial firing opening of the nipples themselves require frequent cleaning, and this is usually done with accessories for the firearm, for example, with pins or the like.

In this type of firearm there is a pin for achieving the connection between the barrel and the breech, and this pin is equipped on one of its outside ends with a reentrant groove into which the end of a screwdriver is normally applied, striking the pin for its extraction, to disconnect the barrel and breech.

SUMMARY OF THE INVENTION

An object of the invention is to achieve a nipple wrench for muzzle-loading type firearms which eliminates the lugs of conventional wrenches, making its use safer and lengthening its useful life, while allowing the tightening force necessary for the nipple to be applied without risk of breaking.

Another object of the invention is achieving an inside space in the nipple wrench in which is housed two spare nipples, perfectly centered and immobilized in its interior.

Another object of the invention is to place an end plug on the wrench which is screwed to the free end and incorporates a needle which is introduced into the inside of the wrench going through the axial openings of the two nipples housed inside of it.

Another object of the invention is to provide a crosswise wrench pin for handling the wrench, with one end threaded and with the other end like the tip of a screwdriver.

Another object of the invention is making a ramrod for loading the firearm, with a stable and fixed positioning of the metal ends thereof which guarantees its continuous ability to function.

To make the nipple wrench according to the present invention, a cold-drawn tube is provided having a circular exterior and also a circular interior and equipped with two bevels or interfaces in the form of openings in the tube and disposed in parallel and at the same distance from the axis of the tube. This tube is later machined for providing an outside end portion truncated substantially conically.

In this machining, an axial cylindrical inside housing of greater dimension than the previous one is made, which is stopped at a distance approximately corresponding to the beginning of the larger base of the truncated conical outside end. The end portion of this cylinder inside is threaded a certain height, and below this threaded portion an axial perforation is made which forms two openings aligned for the rear housings of a wrench handling pin.

The pin is a cylindrical element whose outside diameter corresponds to the inside diameter of the axial perforations of the wrench body, such that it fits into the perforations with a slight amount of play. The pin has one end with a threaded projection of smaller diameter in which an operating handle or knob is screwed. The other end of the pin is made and shaped like a tip of a screwdriver.

An opening passes through the central portion of the pin across the pin relative to the axis of the pin. The utility of the opening will be seen below.

The nontruncated conical end of the wrench body is supplied with a kind of nut having a portion with a manually manipulable striated exterior, the other portion or neck at the front end is provided with threads, by which it is screwed to the end of the wrench body.

The free end of this nut, on the side of the interior of the wrench body, is made as an extension or cylindrical boss with a blind axial opening. The outermost front surface of this extension penetrates into the inside of the wrench body, once the threaded portion has penetrated into the corresponding end.

The blind axial opening of the nut receives on its inside an end of a cleaning rod which, as indicated, also goes through the nipples stored inside the wrench body. Further, the cleaning rod also goes through the crosswise opening of the pin and, at the same time it secures the nipples, it also secures the positioning of the pin.

This entire assembled unit, as said above, constitutes an independent unit able to be used as a wrench for handling the nipple as a nipple cleaning rod that can be reused and as a disassembly unit to act on the pin that connects the breech and barrel of the firearm.

It is to be noted that the truncated conical end of the wrench body is closed in its entire outside contour, and that its inside is partially circular with two opposite plane faces to house the central portion of the nipple, receiving the truncated conical end of the nipple. This inside section of the truncated conical end of the wrench which, when closed, receives perfectly the entire conntour of the nipple in its central portion, is more resistant and more lasting than the prior art devices.

When the firing passage of a nipple, which is mounted in the firearm, requires cleaning, it is loosened with the wrench and then extracted, the upper nut holding the cleaning rod being unscrewed to introduce the rod into the firing passage of the nipple, the wrench with the nut and rod later being fastened and the nipple screwed into the barrel.

To loosen the pin that connects the barrel and breech, the crosswise pin or handle is acted on either by removing it from the wrench by also removing the nut and cleaning rod or directly by acting on its end with pressure or a blow on the pin slot between the breech and barrel.

For its part, the barrel ramrod offers the advantageous feature that its end metal parts are located by being fastened by pressure also on the ends of the ramrod body itself, which is made of wood. The present invention avoids the troublesome positioning of the crosswise pins which secure the metal parts to the central body, by making some notches on the metal ends that penetrate into the wood of the body.

Preferably, these notches are made in groups of three, aligned in the direction parallel to the axis of the ramrod and distributed 102° in each one of the two metal parts. Both the fastening and assembly are notably improved and a perfect fit is achieved.

BRIEF DESCRIPTION OF THE DRAWINGS

These and other details of the invention will be seen in greater detail in the accompanying sheets of drawings, shown only by way of example, in which.

DETAILED DESCRIPTION OF THE PREFERRED EMBODIMENTS

Figure 1:
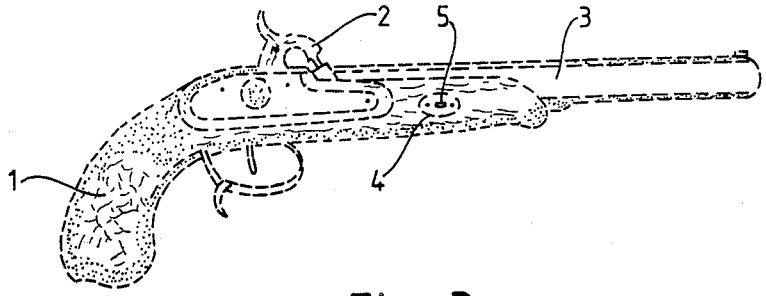
FIG. 1 is a diagrammatic view of a firearm, specifically a pistol, which shows the grooved end of connection of the barrel and breech.

As shown in FIG. 1, a conventional firearm is equipped with a breech 1 and barrel 3, a nipple 2 on which is placed a cap and which is acted on by the hammer and a plate 4 which receives a pin that connects barrel 3 and breech 1. The pin is provided with a groove 5 which is acted on to remove the pin to separate the barrel and breech.

Figure 2:
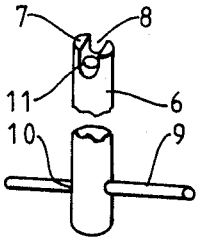
FIG. 2 is a diagrammatic perspective view of a conventional nipple wrench.

FIG. 2 shows in perspective a conventional wrench 6 equipped with a pin or handle 9 fastened to the passing opening by projections 10 or any other means. The upper end of this wrench 6 comprises parallel lugs 7 to facilitate an entry point 8 for the nipple and opening 11 for receiving its conical end.

Figure 3:
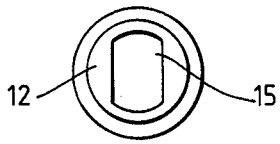
FIG. 3 is a top view of the central body of the wrench, on the side of its truncated conical end, according to the invention.
Figure 4:
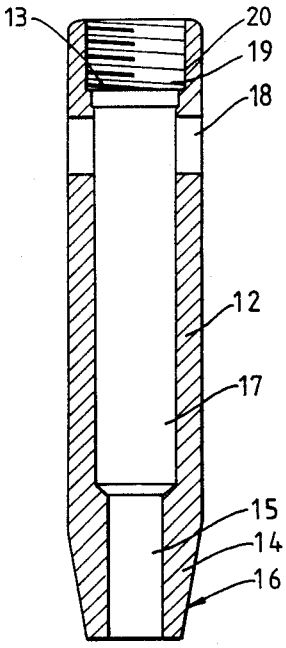
FIG. 4 is a front view of the central body shown in FIG. 3.

The wrench body 12 according to the present invention as shown in FIGS. 3 and 4 is made with a truncated conical end 16 which is totally closed and which provides a specific opening 15 receiving the nipple. The inside is provided with an opening 17 threaded on its upper end 19-20 up to a portion 13 and perforated crosswise by openings 18 below the portion 13.

Figure 5:
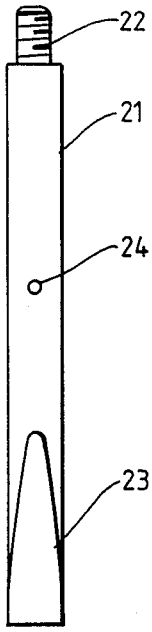
FIGS. 5 and 6 show two elevation views of the wrench pin or handle, according to the invention.
Figure 6:
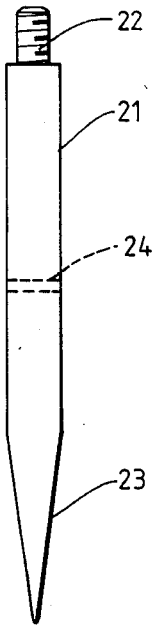
Figure 7:
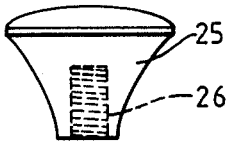
FIG. 7 refers to the lock or grip for the pin.

Pin 21, as shown in FIGS. 5 and 6, to be inserted into and housed by openings 18, has a threaded end 22 at one end thereof. In another embodiment, the end 22 is not threaded and is pressure-fit to grip 25. The other end of pin 21 is formed like a screwdriver, having two flattened inclined surfaces. A central opening 24 is formed in pin 21 between the two ends so as to correspond substantially with the middle of hole 17 of wrench body 12 when pin 21 is inserted therein. An operating knob, grip 25 of FIG. 7 is positioned by screwing the inside of threaded hole 26 of grip 25 onto the threaded end 22 of pin 21 after the pin is inserted into the wrench body 12.

Figure 9:
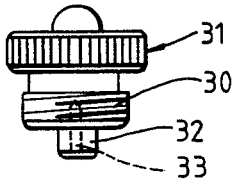
FIG. 9 shows the nut or support of the cleaning rod according to the invention.
Figure 8:
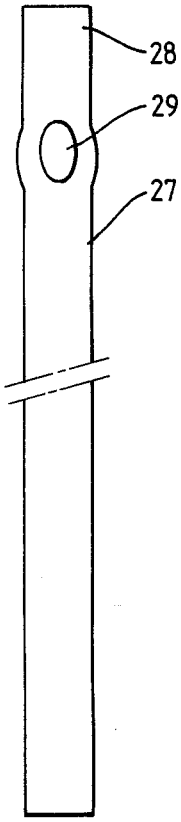
FIG. 8 is a view of the cleaning rod according to the invention.

FIG. 9 shows a nut or support 31 which locks onto end 19-20 of wrench body 12 by screwing of portion 30 therein. Extension 32 of support 31 is equipped with perforation or opening 33 which receives end 28 of rod 27 shown in FIG. 8. A flattened zone 29 is formed in the vicinity of end 28 of rod 27, which will correspond to the depth of penetration of end 28 into perforation 33.

Figure 11:
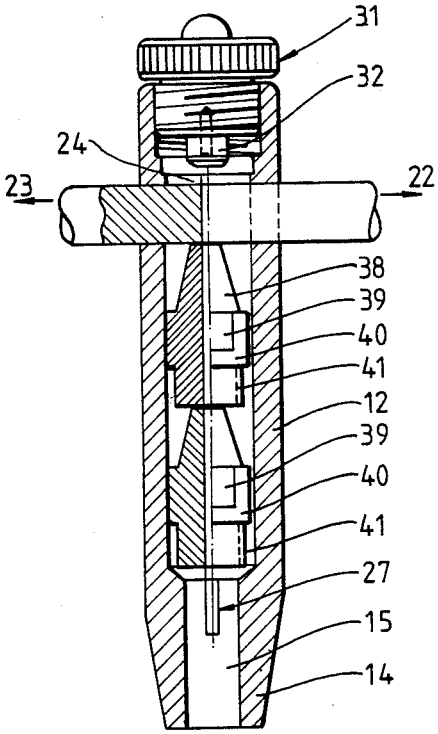
FIG. 11 shows the assembly and relation of the various elements of the wrench according to the invention.

FIG. 11 shows the assembly of these parts, along with two nipples housed on the inside of wrench body 12. In FIG. 11 conical portion 38, central portion 39-40 and threaded portion 41 of the nipples can be seen. Once these nipples have been housed in the wrench body, pin or handle 21 and rod 27 with nut 31 are introduced so that rod 27 goes through opening 24 of handle 21 and through the firing passages of the nipples housed on the inside.

Opening 24 of handle 21 is 1.5 mm in diameter, for example, and the diameter of the rod is 0.6 mm to facilitate easy penetration of rod 27 through and to the nipples.

Pin 21 fits into the wrench body and opening 24 is perpendicular to end 23 with a screwdriver point so it is suitably positioned for penetration by rod 27.

Figure 10:
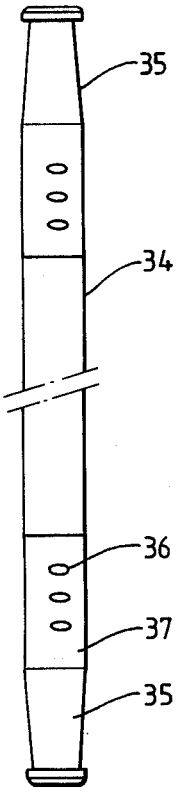
FIG. 10 relates to the ramrod according to the invention.

FIG. 10 shows a view of the ramrod with its central portion 34 and metal lateral bushings 35 which exhibit some notches 36 that penetrate into wood body 34 and provide a suitable fit of the metal bushings 35 onto central portion 34.

To make the nipple wrench according to the present invention, a cold-drawn tube is provided having a circular exterior and also a circular interior and equipped with two bevels or interfaces in the form of openings in the tube and disposed in parallel and at the same distance from the axis of the tube. This tube is later machined by providing an outside end portion truncated substantially conically.

During this machining, an axial cylindrical inside housing of greater dimension than the previous one is formed, which is stopped at a distance approximately corresponding to the beginning of the larger base of the truncated conical outside end. The end portion of this cylinder inside is threaded a certain height, and below this threaded portion an axial perforation is made which forms two openings aligned for the rear housings of a wrench handling pin.

The pin is a cylindrical element whose outside diameter corresponds to the inside diameter of the axial perforations of the wrench body, such that it fits into the perforations with a slight amount of play. The pin has one end with a threaded projection of smaller diameter in which an operating handle or knob is screwed. The other end of the pin is made and shaped like a tip of a screwdriver.

An opening passes through the central portion of the pin across the pin relative to the axis of the pin. The utility of the opening will be seen below.

The nontruncated conical end of the wrench body is supplied with a kind of nut having a portion with a manually manipulable striated exterior, the other portion or neck at the front end is provided with threads, by which it is screwed to the end of the wrench body.

The free end of this nut, on the side of the interior of the wrench body, is made as an extension or cylindrical boss with a blind axial opening. The outermost front surface of this extension penetrates into the inside of the wrench body, once the threaded portion has penetrated into the corresponding end.

The blind axial opening of the nut receives on its inside an end of a cleaning rod which, as indicated, also goes through the nipples stored inside the wrench body. Further, the cleaning rod also goes through the crosswise opening of the pin and, at the same time it secures the nipples, it also secures the positioning of the pin.

This entire assembled unit, as said above, constitutes an independent unit able to be used as a wrench for handling the nipple as a nipple cleaning rod that can be reused and as a disassembly unit to act on the pin that connects the breech and barrel of the firearm.

It is to be noted that the truncated conical end of the wrench body is closed in its entire outside contour, and that its inside is partially circular with two opposite plane faces to house the central portion of the nipple, receiving the truncated conical end of the nipple. This inside section of the truncated conical end of the wrench which, when closed, receives perfectly the entire contour of the nipple in its central portion, is more resistant and more lasting than the prior art devices.

When the firing passage of a nipple, which is mounted in the firearm, requires cleaning, it is loosened with the wrench and then extracted, the upper nut holding the cleaning rod being unscrewed to introduce the rod into the firing passage of the nipple, the wrench with the nut and rod later being fastened and the nipple screwed into the barrel.

To loosen the pin that connects the barrel and breech, the crosswise pin or handle is acted on either by removing it from the wrench by also removing the nut and cleaning rod or directly by acting on its end with pressure or a blow on the pin slot between the breech and barrel.

For its part, the barrel ramrod offers the advantageous feature that its end metal parts are located by being fastened by pressure also on the ends of the ramrod body itself, which is made of wood. The present invention avoids the troublesome positioning of the crosswise pins which secure the metal parts to the central body, by making some notches on the metal ends that penetrate into the wood of the body.

Preferably, these notches are made in groups of three, aligned in the direction parallel to the axis of the ramrod and distributed 102° in each one of the two metal parts. Both the fastening and assembly are notably improved and a perfect fit is achieved.

What is claimed is:

1. A nipple wrench for muzzle-loading firearms, comprising:

a tubular body having a truncated conical end and a circular opening at the truncated conical end, said tubular body having cylindrical inner walls defining a hollow longitudinal opening within said tubular body extending along a longitudinal axis, said opening being connected with said hollow longitudinal opening at one end thereof and the other end thereof terminating in a portion having a smaller diameter than said hollow longitudinal opening, the smaller diameter portion being defined by circular threaded walls, said tubular body including two perforations disposed perpendicular to the longitudinal axis of said tubular body, said two perforations being aligned with one another and having a circular cross-section, said truncated conical end of said tubular body being adapted to receive, on its inside, a portion of a nipple for positioning the nipple or removing the nipple from the firearm, said hollow longitudinal opening being adapted to receive replacement nipples positioned with their longitudinal axes coincident with the longitudinal axis of said tubular body;

a cylindrical pin having a center portion of said pin which is adapted to be inserted into said two perforations of said tubular body and located so as to correspond to a substantially central longitudinal axis of said tubular body and being provided with a circular perforation; and a nut having a threaded end adapted to be screwed into a threaded section of said smaller diameter portion of said tubular body, said threaded end having an axial projection provided with a blind opening which receives one end of a rod, which is adapted to pass through the circular perforation of the pin and firing passages of the nipples housed in said tubular body.

2. The nipple wrench according to claim 1, wherein said cylindrical pin has one end having two flattened inclined surfaces and a second end having threads adapted to receive an operating knob.

3. The nipple wrench according to claim 1, wherein at least two nipples are disposed in the hollow longitudinal opening between an outside surface of said pin and the truncated conical end of said tubular body and the rod on said nut passes through said at least two nipples and projects from the nipple closest to the truncated conical end.

4. The nipple wrench according to claim 1, wherein said nut comprises a projecting portion of screwing and unscrewing said nut from said tubular body.

5. The nipple wrench according to claim 1, wherein the one end of said pin having the two inclined faces is of a suitable size for being housed in a groove of a pin which connects a breech and barrel of the firearm and said pin is operated by the operating knob.

6. Accessories for muzzle-loading firearms comprising the nipple wrench according to claim 1, and further comprising a ramrod having cylindrical metal parts adapted to be pressure-fit onto ends of a wood portion of said ramrod, said metal parts having a plurality of notches regularly distributed on the ends of the wood portion of said ramrod.

* * * * *